United States Patent [19]

Bernasconi et al.

[11] Patent Number: 4,622,047

[45] Date of Patent: Nov. 11, 1986

[54] HOMOGENEOUS AND STABLE COMPOSITION OF ASPHALTENIC LIQUID HYDROCARBONS AND ADDITIVE USEFUL AS INDUSTRIAL FUEL

[75] Inventors: Christian Bernasconi, Charly par Vernaison; Alain Faure, Saint Chamond; Bernard Thibonnet, Crecy La Chapelle, all of France

[73] Assignee: Elf France, Paris, France

[21] Appl. No.: 816,566

[22] Filed: Jan. 6, 1986

[30] Foreign Application Priority Data

Jan. 17, 1985 [FR] France ..... 85 00662

[51] Int. Cl.[4] ..... C10L 1/18

[52] U.S. Cl. ..... 44/62; 44/63; 44/71

[58] Field of Search ..... 44/63, 71, 62

[56] References Cited

U.S. PATENT DOCUMENTS

| | | | |
|---|---|---|---|
| 3,920,414 | 11/1975 | Steere et al. | 44/71 |
| 4,204,481 | 5/1980 | Malec | 44/71 |
| 4,375,974 | 3/1983 | Maldonado et al. | 44/71 |
| 4,433,977 | 2/1984 | Carrier et al. | 44/71 |

*Primary Examiner*—Jacqueline V. Howard

*Attorney, Agent, or Firm*—Burgess, Ryan & Wayne

[57] ABSTRACT

Industrial fuels comprised of mixtures of asphaltenic heavy hydrocarbon fractions and light fractions are provided wherein the flocculation of asphaltenes is minimized by the addition of from 50 to 5000 ppm of an additive composed of a constituent A and/or a constituent B to render the composition homogeneous and stable. Constituent A results from the condensation of a linear N-alkyl polyamine with a cyclic anhydride and constituents B results from the reaction of an ethoxylated amine with a carboxylic acid of $C_8$ to $C_{30}$.

15 Claims, No Drawings

HOMOGENEOUS AND STABLE COMPOSITION OF ASPHALTENIC LIQUID HYDROCARBONS AND ADDITIVE USEFUL AS INDUSTRIAL FUEL

FIELD OF THE INVENTION

This invention is directed to a homogeneous and stable composition of asphaltenic liquid hydrocarbons and at least one additive which renders the composition particularly useful as an industrial fuel.

BACKGROUND OF THE INVENTION

Industrial fuels are used as combustibles for producing calories, specially in the form of hot water steam. In the maritime field these fuels are particularly useful as motor fuels in the engines of navel vessels.

These fuels are obtained by mixing fractions of heavy and light hydrocarbons. To meet the specifications of the user, the characteristics of the final product such as its viscosity, density and sulfur content are adjusted by varying the proportions of the constituents of the fuels.

As fraction of heavy hydrocarbons there are used the residues of atmospheric or vacuum distillation and/or residues of atmospheric or vacuum distallation of charges which have undergone a thermal treatment such as viscoreduction.

The light fractions called fluxants can be selected among products of direct distillation of petroleum: kerosene, illuminating oil, light gasoil, medium gasoil, heavy gasoil, products of vacuum distillation of the atmospheric residue: light gasoil under vacuum, medium gasoil under vacuum, heavy gasoil under vacuum, distillate, products of atmospheric or vacuum distillation of the effluents of the conversion units: gasoil of viscoreduction, distillate of viscoreduction, gasoil of catalytic cracker (LCO), or heavy gasoils of catalytic cracker (HCO, light oil, slurry).

This list of the different constituents of industrial fuels is not exhaustive, but mentions only the products most frequently found in the refining operation. Other less common units could likewise produce fractions that take part in the production of industrial fuels (for example, deasphalters and coke burners).

The industrial fuels resulting from these mixtures contain 3 groups of products:

(a) asphaltenes which are the heaviest molecules contained in raw petroleum, (b) resins which are polar molecules serving as "solubilization" agents of asphaltenes in the hydrocarbonated matrix, and (c) oil or matrix which is the major portion of the fuel.

According to the chemical nature of the matrix (aromatic, naphthenic, paraffinic), the "solubility" of the asphaltenes can be very different. It is possible to observe in certain cases a very quick dissociation of the fuel with precipitation of the heaviest molecules. This phenomenon is further accentuated in the mixture of two fuels of very different origins, that is, resulting from different crude oils. For instance, the mixture of a high asphaltenic fuel with a high paraffinic fuel (or fluxant). This phenomenon of incompatibility involves the precipitation of part of the industrial fuel.

Another source of difficulties is associated with the utilization of hydrocarbon fractions that have undergone a thermal cracking. In fact, in the last few years and in most countries of the world, the refining industry has had to adapt in order to meet an increasing demand for white product (gasoline, kerosene, motor gasoil, domestic fuel) and a decreasing demand for black products (industrial fuels). The use of conversion units that allow the production of light fractions from heavier products makes it possible to satisfy the demand of the market, but leads the refiner to use cracked products in the formula of industrial fuels (viscoreduced products, effluents of the catalytic cracker or effluents of the coke burner). These products in which the chemical structure has been deeply modified can lead to the formulation of unstable industrial fuels that change in the course of their storage and result in a progressive increase of the viscosity due to the chemical rearrangement of the reactive molecules contained in the fuel and to a precipitation of the heavier fractions as result of the flocculation of the asphaltenes.

These phenomena of precipitation of asphaltenes and increase in viscosity create difficulties both for land and maritime uses.

For land use, the exploiter can find problems such as:

warping of the suction strainers, plugging of the filters, very considerable losses of charge in the transportation lines, warping of the pulverization holes, formation of deposits in the storage tanks, or coking of heating systems.

In the maritime field the problems found are of the same nature, but the difficulties for exploitation become more serious for the following reasons:

The combustible contained in the ballasts is permanently shaken by the movements of the vessel (putting back in suspension the deposits formed in the ballasts). Moreover, the combustible is purified by centrifugation in the presence of water and for this reason subjected to a centrifugal force from 100 to 10,000 times greater than the terrestial attraction, and the porosity of the filters used is often less than found in land installations.

The refiner and the user have available only a few effective mens to cope with these difficulties. They can either make the formula of the fuel without incorporating cracked products, which leads the refiner to operate less efficiently and causes unbearable financial losses, or use additives. However, the existing additives, which are dispersing agents, simply delay the phenomenon of flocculation of the asphaltenes in fuels for land use which are simply subjected to land problems but prove themselves ineffective when the fuel is centrifuged in a maritime use.

The object of this invention, therefore, is to provide a composition that remains homogeneous and stable when used on land as well as when used in the maritime field.

SUMMARY OF THE INVENTION

The composition according to the invention includes specific additives that make it possible, on the one hand, to maintain in the form of colloidal solution all the heavy molecules of the asphaltene type present in the industrial fuels, and on the other hand, to prevent the flocculation of these molecules even under a strong acceleration such as encountered when the fuels are employed at sea.

DETAILED DESCRIPTION OF THE INVENTION

The additives according to the invention have the added advantage that they can be used remedially, that is, after a flocculation appears, and not merely preventively. Therefore, they make it possible effectively to treat the user's problems without useless expenses, since only the unstable or incompatible combustible and/or motor fuel is treated. Thus, in case of stratification in a storage tank only the portion of the stock that is difficult to use need be treated with the additive.

The additives of this invention are composed by a constituent (A) and/or a constituent (B) defined as indicated below:

The constituent (A) results from the condensation of at least one cyclic anhydride and at least one linear N-alkyl-polyamine.

The linear N-alkyl-polyamines correspond to the following general formula:

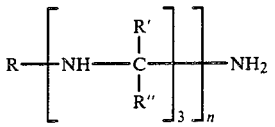

(I)

wherein n is an integer at least equal to 1; R is a hydrocarbon radical saturated or unsaturated, of $C_{10}$ to $C_{22}$; R' and R'' can be identical or different and are selected from the grop consisting of hydrogen and monovalent hydrocarbonated radicals of 1 to 3 carbon atoms. Among the linear polyamines of formula (I) that can be used, there are the following particularly advantageous examples:

N-oleyl-1,3-diamino-propane,
N-stearyl-1,3-diamino-propane,
N-oleyl-1-methyl-1,3-diamino-propane,
N-oleyl-2-methyl-1,3-diamino-propane,
N-oleyl-1-ethyl-1,3-diamino-propane
N-oleyl-2-ethyl-1,3-diamino-propane,
N-stearyl-1-methyl-1,3-diamino-propane,
N-stearyl-2-methyl-1,3-diamino-propane,
N-stearyl-1-ethyl-1,3-diamino-propane,
N-stearyl-2-ethyl-1,3-diamino-propane,
N-oleyl-dipropylene-triamine,
N-stearyl-dipropylene-triamine,
and mixtures thereof.

The cyclic anhydrides can correspond to the following general formulae:

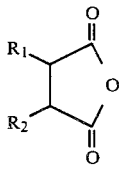

(II)

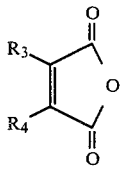

(II')

-continued

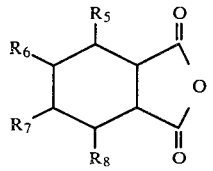

(II'')

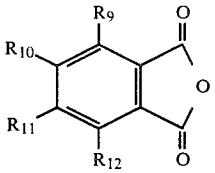

(II''')

wherein R1, R2, R3, R4, R5, R6, R7, R8, R9, R10, R11 and R12 can be identical or different and are selected from the group consisting of hydrogen and monovalent hydrocarbon radicals of 1 to 5 carbon atoms.

The condensation of the anhydrides of formulae (II to II''') with the amines of formula (I) in order to obtain the compound (A) can be carried out without solvent, but there will be preferably used an aromatic hydrocarbon having a boiling point comprised between 70° C. and 250° C. such as: toluene, xylene, diisopropyl benzene, or an aromatic petroleum fraction having the desired range of distillation.

The procedure is the following: the polyamine is gradually introduced in an anhydride solution while keeping the temperature between 30° C. and 80° C., the temperature is then raised to 120° C.-200° C. to eliminate the water formed either by carrying along an inert gas such as nitrogen or argon or by azeotropic distillation with the selected solvent. The duration of the reaction after adding the polyamine is between 2 hours and 8 hours and preferably between 3 hours and 6 hours.

The constituent B results from the reaction of an ethoxylated amine with at least one carboxylic acid with $C_8$ to $C_{30}$.

The ethoxylated amine corresponds to the general formula:

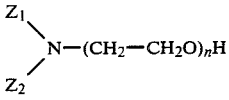

(III)

wherein $Z_1$ corresponds to hydrogen or a group $(—CH_2—CH_2—O)_{n'}H$; $Z_2$ corresponds to hydrogen or a group $(—CH_2—CH_2—O)_{n''}H$; and n, n' and n'' are integers of from 1 to 12 and preferably from 1 to 3.

The carboxylic acids are selected from:

saturated or unsaturated aliphatic acids having a straight or branched chain such as the fatty acids of $C_{16}$ to $C_{22}$,
cyclic acids such as naphthenic acids,
terpenic acids such as resinic acids,
aromatic acids such as carboxylic alkylaryl acids.

These two constituents A and B can be used separately, but using them mixed makes it possible to obtain clearly better results, since a synergistic effect exists between these two constituents.

If the two constituents are used mixed, the constituent (A) represents from 5 to 95% by weight, preferably from 30 to 80%, and the constituent (B) represents from 95 to 5%, preferably from 70 to 20%.

The gravimetric concentration of the constituents A and/or B in the fuel to be treated will change, according to the nature of the problems to be solved, from 50 to 5000, preferably from 250 to 2000 ppm.

The additive can be diluted by any solvent to facilitate the use, but it is preferable to select a solvent of aromatic type having an initial distillation point above 150° C.

To this composition can be added, in case of continuous treatment, other constituents that act on the combustion of the industrial fuel such as: the iron-based organometal combustion catalysts, barium, calcium, manganese, cerium, zirconium and magnesium in oil-soluble form or the organic combustion catalysts such as alcohols or ether alcohols.

For a continuous treatment the process according to the invention consists in injecting the additive into the storage tank at the moment of filling, but the preferred procedure of the invention consists in injecting the additive by regulating pump at the storage tank exit in case of a ground installation or at the ballast exit prior to the centrifugation when used at sea, in the amount of 50 to 5000 ppm, preferably 250 to 2000 ppm.

The additives of this invention can be used for the treatment of industrial and maritime fuels defined as above and in which the kinematic viscosity at 50° C. is comprised between 50 to 550 cst.

The effectiveness of the additives has been tested both in the laboratory and in naval installations and the following examples illustrate the invention but without limiting the scope thereof.

EXAMPLES 1 TO 4

The object of these examples is to show the effectiveness on an incompatible maritime fuel 180 cst at 50° C. (compatibility test ASTM D 2781: 5) formulated at the laboratory from different additives of the invention using a laboratory centrifuge revolving at 3000 t/mn for 3 mn at a temperature of 98° C. After centrifugation, the pipe of the centrifuge is inverted to allow the fuel to drain. The centrifugation slag is then weighed and brought back to the weight of the sample (results expressed in % by weight).

ADDITIVE 1: contains only the compound (A) obtained by condensation, according to the test conditions described above, of phthalic anhydride and N-stearyl methyl-1-diamino-1,3-propane.

ADDITIVE 2: contains only the compound (B) obtained by di-esterification of diethanolamine by tall acid.

ADDITIVE 3: contains only the compound (A) obtained by condensation, according to the test conditions described above, of maleic anhydride and N-oleyl-diamino-1,3-propane.

ADDITIVE 4: contains only the compound (B) obtained by esterification of tri-ethanolamine by a tallow fatty acid in a molecular proportion of 1 to 2 (di-esterification).

| ADDITIVES | WITHOUT | 1 | 2 | 3 | 4 |
|---|---|---|---|---|---|
| CONCENTRATION WEIGHT ppm | — | 2000 | 2000 | 2000 | 2000 |
| SLAG % BY WEIGHT | 2.9 | 1.6 | 1.5 | 1.2 | 1.4 |

EXAMPLES 5 TO 7

The object of these examples is to demonstrate the effectiveness and synergy action of the constituents (A) and (B) on the fuel of the preceding example, under the same operating conditions.

| ADDITIVES | 5 | 6 | 7 |
|---|---|---|---|
| CONCENTRATION RATIO IN COMPOSITION % BY WEIGHT | 25% of 3<br>75% of 4 | 50% of 3<br>50% of 4 | 75% of 3<br>25% of 4 |
| CONCENTRATION IN FUEL ppm, weight | 2000 | 2000 | 2000 |
| SLAG % BY WEIGHT | 0.6 | 0.7 | 1.0 |

EXAMPLE 8

The object of this example is to demonstrate the true extend of effectiveness of the additives of this invention. For reasons of operation this additive contained 50% heavy aromatic solvent having a lightening point above 65° C. and 50% of the mixture of the compound (A) and of the compund (B) in the gravi- The compound (A) is obtained by condensation, according to the test conditions described above, of maleic anhydride and N-oleyl-diamino-1,3-propane.

The compound (B) is obtained by esterification of tri-ethanolamine by a tallow fatty acid in a molecular ratio of 1 to 2.

This additive was used in a dosage of 1000 ppm by injection by regulating pump in the maritime combustible prior to centrifugation.

The analysis of this combustible by the customary standardize methods was the following:

| | | |
|---|---|---|
| Kinematic viscosity at 50° C. | 179 | Cst |
| Volumetric mass at 15° C. | 0.968 | g/ml |
| Water content | 0.3% | by weight |
| CONRADSON carbon | 11.8% | by weight |
| Sulfur content | 2.5% | by weight |
| Ash content | 0.5% | mg/kg |
| Vanadium content | 54 | mg/kg |
| Sodium content | 63 | mg/kg |
| Aluminum content | 2 | mg/kg |
| Inferior heating power | 40.31 | mg/kg |

The tests were carried out in different vessels in which the combustibles had anomalies in their function.

The case here involved concerns a vessel where the motor feeding circuit was established as follows: Suction in the ballast toward a decanting tank having a volume of 60 $m^3$, then compression in the journal box having a volume of 19 $m^3$, passing by a separator of the type having a self-cleaning bowl, rotating at 1455 T/mn with a delivery of 5400 l/h, the excess of the journal box returning in close loop to the decanting tank.

Before the inejection pump were mounted automatic filters of fine metal gauze of stainless steel with a delivery of 100 $m^3$/h and a mesh of 30 um.

During a passage the clogging of the automatic combustible filters became so great that it was necessary to make use of manual filters mounted in parallel and to carry out several cleaning operations to be able to ensure the operation of the motors.

After a complete cleansing of the feeding systems and port side and starboard filtration, it will be found that the interval between two cleaning operations was less than 5 minutes and that it would be necessary to clean the manual filters every 20 minutes.

The circuit of starboard combustible was treated with the additives and following the steps mentioned above, the port circuit continued using the untreated combustible (identical port and starboard circuits).

| DURATION OF THE TREATMENT (h) | | — | 2 | 4 | 8 | 11 |
|---|---|---|---|---|---|---|
| Interval between two cleanings of the filters (minute) | starboard circuit (treated) | 4 | 9 | 13 | 22 | 30 |
| | Port circuit | 4 | 4 | 3 | 3 | 3 |

At the end of 11 hours of treatment the frequency of the cleaning changed from 4 to 30 minutes.

EXAMPLE 9

The starboard circuit of the preceding example was treated thereafter for a period of 12 hours with an identical composition in which only the gravimetric ratio of the compound (A) and of the compound (B) was different: 1 to 1 instead of 2 to 1. After 12 hours of use under conditions identical with those described above, the interval between 2 cleaning operations came back to normal (30 mn).

In another vessel equipped with the material described above, the anomalies in operation were eliminated quickly by using the treatment.

For an injection of the product at a dose of 1/1000, 6 l/h, when the frequency of cleaning has been reduced to 5 minutes, the results obtained were as follows:

with 20 minutes of treatment: the frequency of cleaning changed to 10 minutes, with 1 hour of treatment: the frequency of cleaning changed to 20 minutes, the injection being then reduced to 4 l/h, with 2 hours of treatment: the frequency of cleaning goes back to normal, that is, 40 minutes

What is claimed is:

1. A homogeneous and stable composition of asphaltenic liquid hydrocarbons useful as an industrial fuel, said composition comprised of a major quantity of said hydrocarbons and a minor quantity of at least one stabilizing additive for preventing the flocculation of asphaltenes, said additive selected from the group consisting of constituent A resulting from the condensation of at least one cyclic anhydride and at least one linear N-alkylpolyamine corresponding to the general formula:

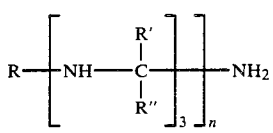

(I)

wherein n is an integer at least 1, R is a saturated or unsaturated hydrocarbon radical of $C_{10}$ to $C_{22}$, R' and R'', are identical or different, and are selected from hydrogen and monovalent hydrocarbon radicals of $C_1$ to $C_3$, and constituent B resulting from the reaction of an ethoxylated amine with at least one carboxylic acid of $C_8$ to $C_{30}$.

2. The composition according to claim 1, wherein said cyclic anhydride corresponds to one of the following formulae:

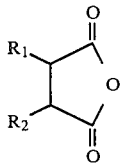

(II)

-continued

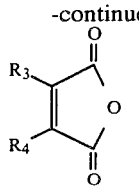

(II')

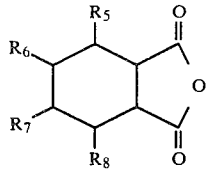

(II'')

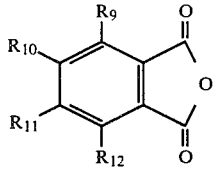

(II''')

wherein R1, R2, R3, R4, R5, R6, R7, R8, R9, R10, R11 and R12 can be identical or different and are selected from the group consisting of hydrogen and monovalent hydrocarbon radicals of 1 to 5 carbon atoms.

3. The composition according to claim 2, wherein said cyclic anhydride is selected from the group consisting of maleic anhydride and phthalic anhydride.

4. The composition according to claim 1, wherein in the general formula (I) of the linear N-alkylpolyamine, R is a saturated or unsaturated alkyl radical of $C_{16}$ to $C_{22}$ and n is an integer number from 1 to 3.

5. The composition according to claim 4, wherein said linear N-alkyl-polyamine is selected from the group consisting of N-stearyl-methyl-1-diamino-1,3-propane and N-oleyl-diamino-1,3-propane.

6. The composition according to claim 1, wherein said ethoxylated amine corresponds to the general formula:

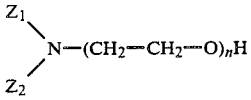

(III)

wherein $Z_1$ represents hydrogen or the group $(CH_2—CH_2O)_{n'}$; H, $Z_2$ corresponds to hydrogen or the group $(CH_2—CH_2—O)_{n''}H$, n, n' and n'' are integers of from 1 to 12.

7. The composition according to claim 1, wherein said carboxylic acid is a fatty acid of $C_{16}$ to $C_{22}$.

8. The composition according to claim 1, wherein said carboxylic acid is a cyclic acid.

9. The composition according to claim 1, wherein said carboxylic acid is a naphthenic acid.

10. The composition according to claim 1, wherein said carboxylic acid is a terpenic acid.

11. The composition according to claim 1, wherein said carboxylic acid is a resinic acid.

12. The composition according to claim 1, wherein said carboxylic acid is a aromatic acid.

13. The composition according to claim 1, wherein said carboxylic acid is an alkylaromatic acid.

14. The composition according to claim 1, wherein said additive is present in the composition in a weight concentration of from 50 to 5000 ppm.

15. The composition according to claim 1, wherein said additive is present in the composition in a weight concentration of from 250 to 2000 ppm.

* * * * *